US011646531B2

(12) United States Patent
Shin et al.

(10) Patent No.: US 11,646,531 B2
(45) Date of Patent: May 9, 2023

(54) DATA SIGNAL TRANSMISSION CONNECTOR

(71) Applicants: Jong Cheon Shin, Gyeonggi-do (KR); Dong Ho Ha, Gyeonggi-do (KR)

(72) Inventors: Jong Cheon Shin, Gyeonggi-do (KR); Dong Ho Ha, Gyeonggi-do (KR)

( * ) Notice: Subject to any disclaimer, the term of this patent is extended or adjusted under 35 U.S.C. 154(b) by 29 days.

(21) Appl. No.: 17/523,356

(22) Filed: Nov. 10, 2021

(65) Prior Publication Data

US 2022/0158386 A1 May 19, 2022

(30) Foreign Application Priority Data

Nov. 17, 2020 (KR) ..... 10-2020-0153547

(51) Int. Cl.

| | |
|---|---|
| ***H01R 13/627*** | (2006.01) |
| ***H01R 12/85*** | (2011.01) |
| ***H01R 13/42*** | (2006.01) |
| ***H01R 12/73*** | (2011.01) |

(52) U.S. Cl.
CPC ..... *H01R 13/6275* (2013.01); *H01R 12/73* (2013.01); *H01R 12/85* (2013.01); *H01R 13/42* (2013.01)

(58) Field of Classification Search
CPC ..... H01R 12/58; H01R 12/85; H01R 12/732; H01R 12/523; H01R 12/714; H01R 12/716; H01R 13/6275; H01R 13/658; H01R 13/2435; H01R 13/42
See application file for complete search history.

(56) References Cited

U.S. PATENT DOCUMENTS

| | | | | |
|---|---|---|---|---|
| 5,329,426 A * | 7/1994 | Villani | ..... | H01L 23/4093 257/719 |
| 5,870,285 A * | 2/1999 | Kosteva | ..... | H01L 23/4093 174/16.3 |
| 6,188,131 B1 * | 2/2001 | Nereng | ..... | H01L 23/4093 257/726 |
| 2011/0063496 A1 * | 3/2011 | Chang | ..... | H04N 23/55 29/842 |

FOREIGN PATENT DOCUMENTS

| | | |
|---|---|---|
| JP | 06-068940 | 3/1994 |
| KR | 20-0391493 | 8/2005 |
| KR | 20-0404628 | 12/2005 |
| KR | 10-2009-0046524 | 5/2009 |
| KR | 10-2010-0023710 | 3/2010 |

* cited by examiner

*Primary Examiner* — Oscar C Jimenez

(57) ABSTRACT

Provided is a data signal transmission connector configured to electrically connect a first electronic component and a second electronic component includes a first base frame and a second base frame having a structure which are mirror-symmetrical, the first base frame and the second base frame being disposed to face each other and to be spaced apart from each other.

19 Claims, 6 Drawing Sheets

< Prior Art >

(a)

(b)

< Prior Art >

(a)

(b)

(a)

(b)

DATA SIGNAL TRANSMISSION CONNECTOR

CROSS-REFERENCE TO RELATED APPLICATION

This application claims priority of Korean Patent Application No. 10-2020-0153547, filed on Nov. 17, 2020, in the KIPO (Korean Intellectual Property Office), the disclosure of which is incorporated herein entirely by reference.

BACKGROUND OF THE INVENTION

Field of the Invention

The present disclosure relates to a data signal transmission connector, and more particularly, to a data signal transmission connector capable of connecting a first electronic component and a second electronic component to enable high-speed signal transmission to be performed.

Description of the Related Art

As 4th industrial revolution technologies such as autonomous vehicles, big data, cloud, and the like are in full swing, 5G services are being commercialized in earnest, and the need for connectors for high-speed signal transmission is emerging.

A data signal transmission connector is an essential component for connection of transmission/reception antennas, cables and the like. Ideally, a data signal connector should minimize signal attenuation and noise, and there should be no signal interference therein during signal transmission.

Currently, a board-to-board (BTB) type connector has been widely used as a data signal transmission connector employed in smartphones. The BTB type connector has a structure in which a pin for signal transmission is bent in a U shape to couple a female member and a male member to each other. Recently, a technology in which a perimeter of a signal transmitting pin is shielded with a metal has been applied to the BTB type connector. A ground is provided between the signal transmitting pins to avoid signal loss or interference pins allowing a signal of about 1 to 2 GHz to be transmitted.

BTB connectors have several problems, however. In the conventional BTB type connector, signal loss and noise cannot be avoided in a U-shaped bent portion of the pin for signal transmitting. In addition, the conventional BTB-type connector has a structure in which a length of the signal transmitting pin bent in U-shape is relatively long, so signal loss is inevitable due to this structure. Furthermore, since the conventional BTB type connector has a structure in which a female member and a male member are coupled to each other, a difference in signal transmission is inevitable depending on the position of a portion where the female member and the male member are in contact with each other. Also, the conventional BTB type connector is inconvenient to assemble.

FIGS. 1 and 2 show a conventional data signal transmission connector. As depicted in FIGS. 1 and 2, a data signal transmission connector 500 using an anisotropic electro-conductive sheet is designed for electrically connecting a first electronic component (not shown) having a first electrode and a second electronic component 120 having a second electrode.

A base frame 130 is secured to the first electronic component and is a member having a space which an anisotropic electro-conductive sheet 160, the second electronic component 120, and a cover frame 170 are seated. This base frame has a base frame floor part 134 having a base frame opening 135 formed therein, a pair of base frame side wall parts 133 disposed on both sides of the base frame floor part to face each other so as to be erected with respect to the base frame floor part 134, a pair of base frame wall parts 131 and 132, and fixing parts provided on the pair of base frame side wall parts, respectively.

In addition, the anisotropic electro-conductive sheet 160 is provided with a plurality of electro-conductive parts including a plurality of electro-conductive particles contained in an elastic insulating material, and an insulating part coupled to the electro-conductive parts to support a portion between the electro-conductive parts. This anisotropic electro-conductive sheet is disposed on the base frame opening 135 formed in the base frame 130.

The cover frame 170 has a body part pressurizing the second electronic component placed on the anisotropic electro-conductive sheet towards the anisotropic electro-conductive sheet such that a lower end portion of the electro-conductive part may be brought into close contact with the first electrode and the second electrode may be brought into close contact with an upper end portion of the electro-conductive part, and a locking part fastened to a fixing part formed on the base frame side wall part 133 of the base frame.

Although the data signal transmission connector 500 may transmit a much higher speed signal as compared with the conventional BTB-type connector, the metal base frame may act as a dielectric and a capacitor or a coil component to have a negative effect on the high-speed signal line and distort the signal.

This signal distortion problem can become a critical problem especially in the case of ultrahigh-speed signal transmission above 28 GHz, which is used, for example, in 5G networks.

More specifically, the base frame 130 shown in FIG. 2 is a component to which the second electronic component having a high-speed signal line formed therein is coupled and includes the pair of base frame side wall parts, the pair of base frame wall parts and the base frame floor part to surround the second electronic element. Therefore, the base frame arranged adjacent to the high-speed signal line through which ultrahigh-speed signal is transmitted has a structure having an effect on the high-speed signal transmission. In particular, intermediate portions of the base frame wall parts 131 and 132 and the base frame floor part 134, which are closely adjacent to a portion through which the high-speed signal line passes, have a serious impact on ultra-fast signal transmission.

It would therefore be desirable to have a connector which avoids these and other drawbacks of existing connectors.

SUMMARY OF THE INVENTION

The present disclosure has been devised in view of the above points, and an object of the present disclosure is to provide a data signal transmission connector suitable for ultrahigh-speed signal transmission due to a structure that minimizes signal interference.

In order to achieve the above object, the present disclosure provides a data signal transmission connector configured to electrically connect a first electronic component having a first electrode and a second electronic component having a second electrode. The data signal transmission connector may include a base frame fixed to the first electronic component, the base frame comprising a first base frame having a floor part and a tension coupling piece extending upward from an outer surface of the floor part, and a second base frame having a structure which is mirror-symmetrical with respect to that of the first base frame, the first base frame and the second base frame being disposed to face each other and to be spaced apart from each other by a gap. The connector also comprises an anisotropic electro-conductive sheet disposed on the floor parts of the base frame and is configured to fill the gap. The anisotropic electro-conductive sheet includes a plurality of electro-conductive parts including a plurality of electro-conductive particles contained in an elastic insulating material and an insulating part supporting a portion between the electro-conductive parts. The connector further comprises a cover frame connectable to the tension coupling piece and capable of pressurizing the second electronic component placed on the anisotropic electro-conductive sheet towards the anisotropic electro-conductive sheet such that a lower end portion of the electro-conductive part is brought into close contact with the first electrode and the second electrode is brought into close contact with an upper end portion of the electro-conductive part. Here, the second electronic component has a plurality of high-speed signal lines, and at least some of the plurality of high-speed signal lines are disposed to pass above the gap.

The floor part may be formed to have a "⊏" shape having an opening formed therein.

The electro-conductive part of the anisotropic electro-conductive sheet may be formed at a portion corresponding to a rectangular region formed by the openings and the gap.

The anisotropic electro-conductive sheet may be not disposed on a portion corresponding to the gap outside the rectangular region.

Each of the first and second base frames may further include a position-aligning piece formed on a rear side of the floor part and extending upward.

The anisotropic electro-conductive sheet and the second electronic component may be position-aligned by the tension coupling piece and the position-aligning piece.

An intermediate frame may be formed within the gap between the position-aligning pieces, and the intermediate frame may include an intermediate floor part on which the anisotropic electro-conductive sheet is disposed, and an intermediate position-aligning piece disposed parallel to the position-aligning piece.

In the data signal transmission connector according to the present disclosure, a first fixing part may be formed on an upper portion of the tension coupling piece and the first fixing part is bent inwardly to have an inner lower inclined surface and an inner upper inclined surface, and the cover frame may have a first coupling part formed on each of both end portions thereof and having an inclined surface corresponding to the inner lower inclined surface.

In addition, the tension coupling piece may be bent outward to form a second fixing part thereon having an outer lower inclined surface and an outer upper inclined surface, and the cover frame may have second coupling parts formed at both end portions thereof and extending downward, and the second coupling part may have a coupling opening formed therein to be coupled with the second fixing part.

Furthermore, the tension coupling piece may be bent outward to form a second fixing part thereon having an outer lower inclined surface and an outer upper inclined surface, and the cover frame may have third coupling parts formed at both end portions thereof, and the third coupling part is bent inward for wrapping an outer surface of the second fixing part.

In the data signal transmission connector according to the present disclosure, by removing a portion of the base frame formed close to a portion through which the high-speed signal line passes, it is possible to transmit a high-speed signal without signal distortion or interference. In particular, in the case of ultrahigh-speed signal transmission, signal distortion may be minimized by partially removing the anisotropic electro-conductive sheet as much as possible except for a portion corresponding to a region of the base frame through which the high-speed signal line passes and a portion where the electro-conductive parts are disposed.

In addition, in the data signal transmission connector according to the present disclosure, it is possible to couple the second electronic component to the base frame, which is coupled to the first electronic component, by simply pressing the cover frame. Accordingly, electrically connecting the first electronic component and the second electronic component can be performed simply and quickly.

In addition, since the electro-conductive part in which the plurality of electro-conductive particles are contained in the elastic insulating material electrically connects the first electrode of the first electronic component and the second electrode of the second electronic component, a signal transmission path is shortened as compared with a conventional BTB connector, and uniform signal transmission may be achieved, thereby enabling high-speed signal transmission to be performed.

BRIEF DESCRIPTION OF THE DRAWINGS

The above and other features and advantages will become more apparent to those of ordinary skill in the art by describing in detail exemplary embodiments with reference to the attached drawings, in which.

In the following description, the same or similar elements are labeled with the same or similar reference numbers.

DETAILED DESCRIPTION

Figure 1:
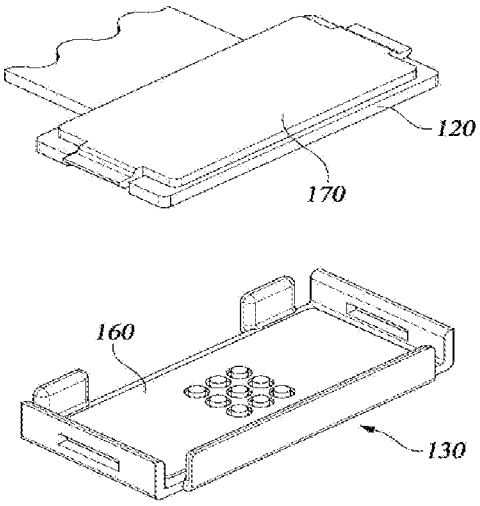
FIGS. 1 and 2 are perspective views showing a conventional data signal transmission connector.
Figure 1:
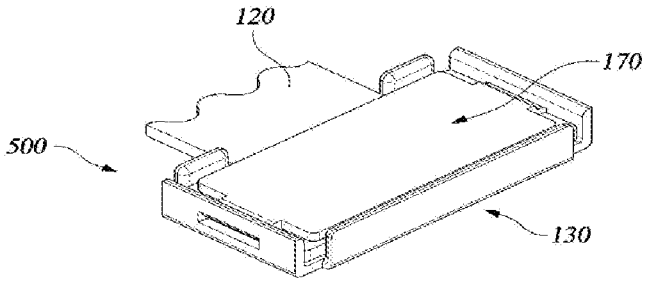

The present invention now will be described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "includes", "comprises" and/or "comprising," when used in this specification, specify the presence of stated features, integers, steps, operations, elements, and/or components, but do not preclude the presence or addition of one or more other features, integers, steps, operations, elements, components, and/or groups thereof. In addition, a term such as a "unit", a "module", a "block" or like, when used in the specification, represents a unit that processes at least one function or operation, and the unit or the like may be implemented by hardware or software or a combination of hardware and software.

Reference herein to a layer formed "on" a substrate or other layer refers to a layer formed directly on top of the substrate or other layer or to an intermediate layer or intermediate layers formed on the substrate or other layer. It will also be understood by those skilled in the art that structures or shapes that are "adjacent" to other structures or shapes may have portions that overlap or are disposed below the adjacent features.

In this specification, the relative terms, such as "below", "above", "upper", "lower", "horizontal", and "vertical", may be used to describe the relationship of one component, layer, or region to another component, layer, or region, as shown in the accompanying drawings. It is to be understood that these terms are intended to encompass not only the directions indicated in the figures, but also the other directions of the elements.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Preferred embodiments will now be described more fully hereinafter with reference to the accompanying drawings. However, they may be embodied in different forms and should not be construed as limited to the embodiments set forth herein. Rather, these embodiments are provided so that this disclosure will be thorough and complete, and will fully convey the scope of the disclosure to those skilled in the art.

Figure 3:
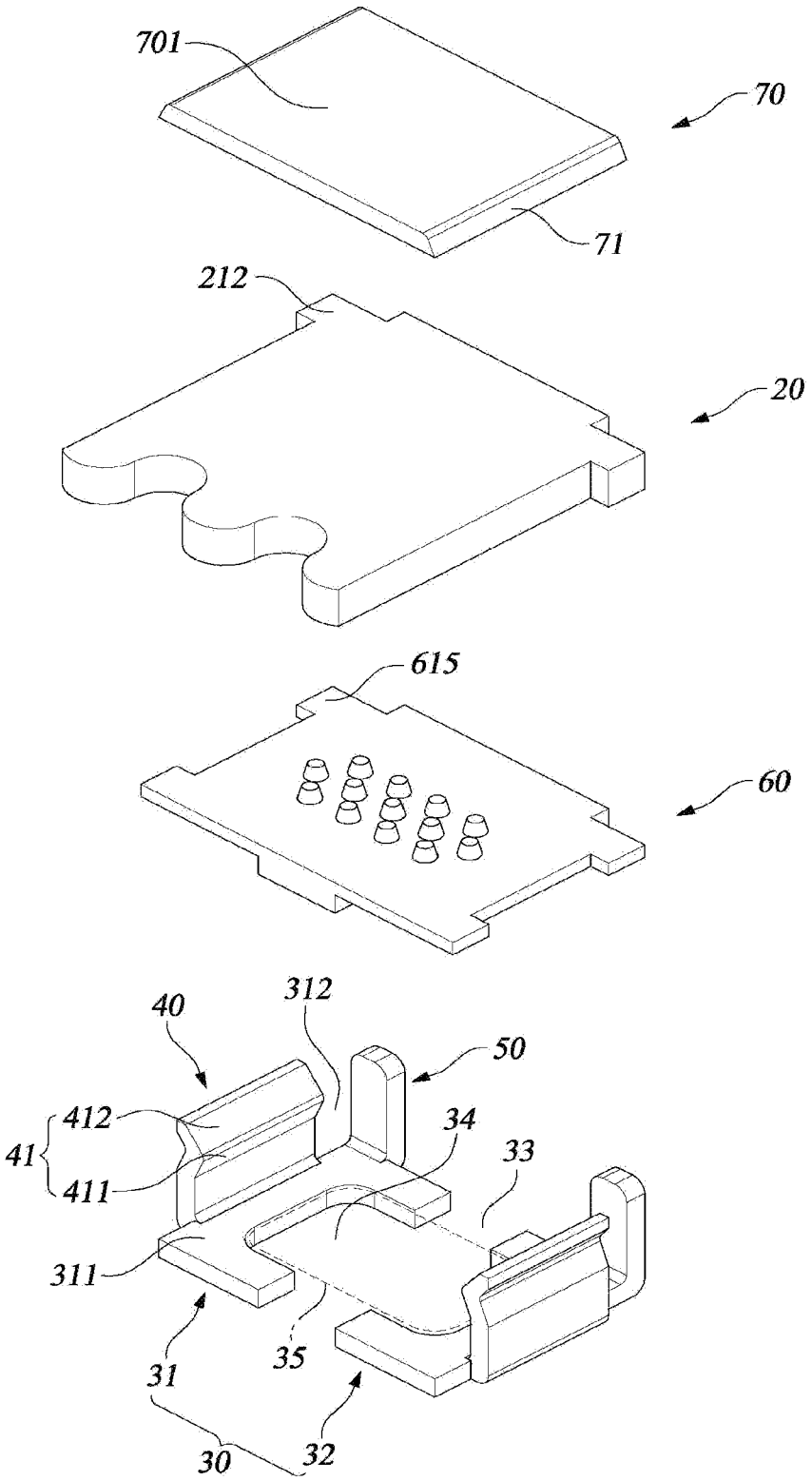
FIG. 3 is an exploded perspective view of a data signal transmission connector according to one embodiment of the present disclosure.
Figure 4:
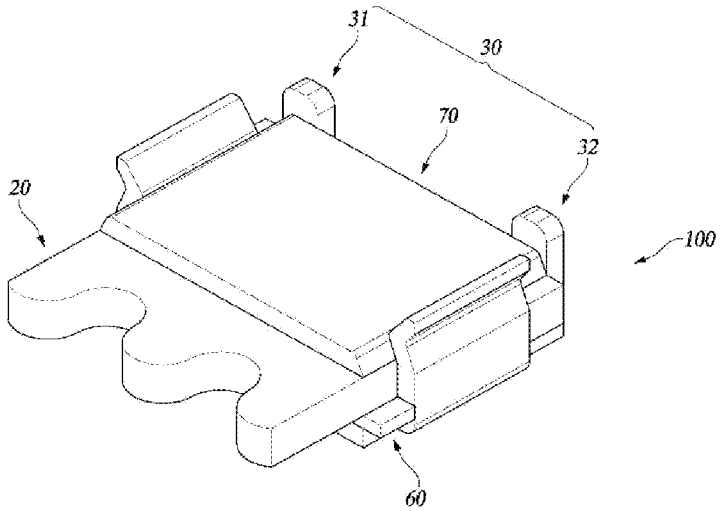
FIG. 4 is a perspective view of the data signal transmission connector according to one embodiment of the present disclosure.
Figure 5:
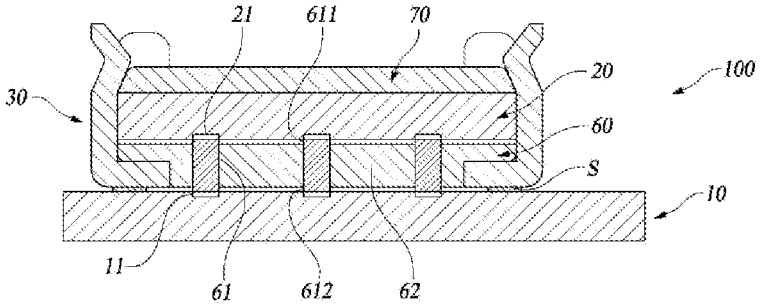
FIG. 5 is a cross-sectional view depicting the data signal transmission connector according to one embodiment of the present disclosure.
Figure 5:
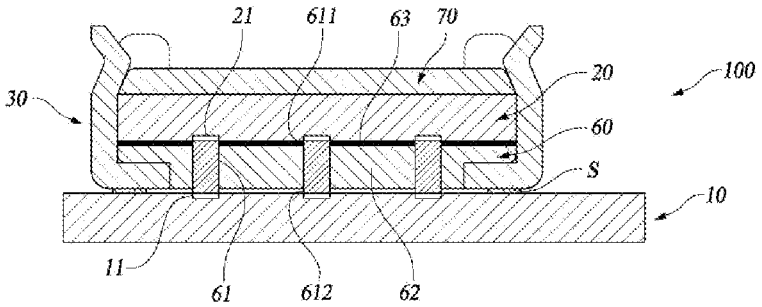

FIG. 3 is an exploded perspective view of a data signal transmission connector according to one embodiment of the present disclosure, FIG. 4 is a perspective view of the data signal transmission connector according to one embodiment of the present disclosure, and FIG. 5 is a cross-sectional view depicting the data signal transmission connector according to one embodiment of the present disclosure.

As shown in the drawings, a data signal transmission connector 100 according to one embodiment of the present disclosure is provided for electrically connecting a first electronic component 10 and a second electronic component 20, and includes a base frame 30 secured to the first electronic component 10 and configured to allow the second electronic component 20 to be mounted thereon, an anisotropic electro-conductive sheet 60 disposed on an upper surface of the base frame, and a cover frame 70 coupled to the base frame 30 while pressurizing the second electronic component 20 disposed on the anisotropic electro-conductive sheet 60 towards the anisotropic electro-conductive sheet 60.

The first electronic component 10 has a first electrode 11 capable of transmitting an electrical signal, and the second electronic component 20 may be an electronic component having various structures having a second electrode 21 capable of transmitting an electrical signal. For example, the first electronic component 10 may be a printed circuit board (PCB) mounted on a smart phone or a portable personal computer (PC), and the second electronic component 20 may be a flexible circuit board (FPCB), an antenna, an electric cable, or the like.

The base frame 30 is comprised of a first base frame 31 and a second base frame 32, and the first base frame 31 and the second base frame 32 are formed to have the structures which are mirror-symmetrical with respect to each other.

The first base frame 31 is provided with a floor part 311 which may be placed on and parallel to an upper surface of the first electronic component 10. The floor part 311 may be formed in the shape of a flat plate having an upper surface, a lower surface, a front surface, a rear surface, an inner side surface and an outer side surface. The inner side surface is defined as a side portion facing the second base frame 32. A tension coupling piece 40 extends upward from the outer side surface of the floor part 311. In addition, a position-aligning piece 50 extending upward from the floor part 311 may be formed on the rear side of the floor part 311. Similarly, the second base frame 32 having the structure which is mirror-symmetrical with respect to that of the first base frame 31 also has the floor part 311 and the tension coupling piece 40 facing the tension coupling piece 40 formed on the first base frame 31. The second base frame 32 may also be provided with the position-aligning piece 50 disposed parallel to the position-aligning piece 50 formed on the first base frame 31.

In the present disclosure, the first base frame 31 and the second base frame 32 having the structures which are mirror-symmetrical with respect to each other are disposed to face each other with a constant gap 33. The anisotropic electro-conductive sheet 60 and the second electronic component 20 may be accommodated in a portion formed by the floor parts 311, the tension coupling pieces 40 and the position-aligning pieces 50 of the first base frame 31 and the second base frame 32.

The floor part 311 of each of the first base frame 31 and the second base frame 32 may be formed in the shape of a rectangular flat plate. Also, as shown in FIG. 3, each of the floor parts 311 may be formed to have a "ㄷ" shape having an opening 34 formed therein, and these openings of the floor parts are opened towards each other. Accordingly, the base frame may be disposed in a state in which the floor parts 311 of the first base frame 31 and the second base frame 32 face to each other on the same plane. The floor part 311 of the base frame 30 is a part to which the anisotropic electro-conductive sheet 60 is attached and on which the second electronic component 20 is seated, and may be provided in various forms according to shapes of the anisotropic electro-conductive sheet 60, the second electronic component 20, etc.

Figure 2:
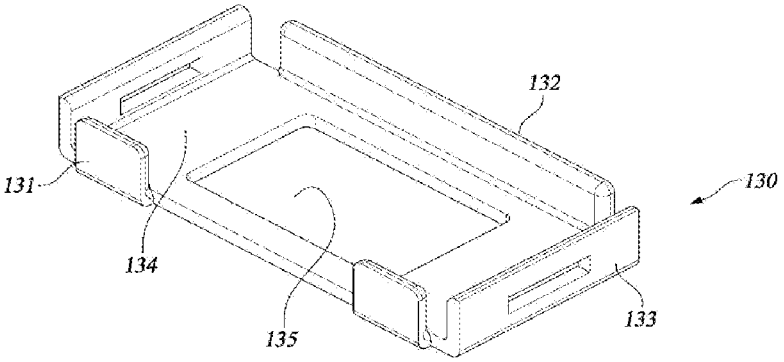

As compared with the base frame 130 shown in FIG. 2, the base frame 30 according to one embodiment of the present disclosure has a structure similar to the structure of base frame 130 in which intermediate portions of the base frame wall parts 131 and 132 and the base frame floor part 134 constituting the base frame 130 shown FIG. 2 are removed. In the base frame 130 having the structure shown in FIG. 2, a high-speed signal line that is a component of the second electronic component 20 (placed on the floor part 134) is placed on the intermediate portions of the base frame wall parts 131 and 132 and the base frame floor part 134. As a result, the intermediate part of the base frame 130 formed of a metal or the like acts as a dielectric and a capacitor or a coil component on the high-speed signal line, and thus the signal is highly likely to be distorted.

Therefore, the present disclosure aims to minimize distortion in signal transmission by removing at least some portions of the conventional base frame 130 that have a negative influence on a high-speed signal line. That is, in the present disclosure, the base frame 30 is composed of the first base frame 31 and the second base frame 32 having the structures which are mirror-symmetrical with respect to each other, and in order to have a structure in which a portion having an influence on a high-speed signal line is removed, the first base frame 31 and the second base frame 32 are disposed to face each other and spaced apart from each other by a predetermined gap 33, and the first base frame 31 and the second base frame 32 disposed to be spaced apart from each other are connected to each other using the anisotropic electro-conductive sheet 60 described later.

In addition, in the base frame 30, the tension coupling pieces 40 formed on the first base frame 31 and the second base frame 32, respectively, accommodate the anisotropic electro-conductive sheet 60 and the second electronic component 20, and are coupled with the cover frame 70. It is preferable to form the cover frame 70 such that when the cover frame 70 is coupled to the tension coupling piece 40, the tension coupling piece 40 is elastically deformed to allow the cover frame 70 to be smoothly coupled thereto.

Since the base frame 30 may be made of a metal material, the tension coupling piece 40 may be formed by bending the floor part of the base frame 30 and thus also formed of a metal material, so when the cover frame 70 is coupled thereto, the tension coupling piece 40 is elastically deformed to enable the cover frame to be smoothly coupled.

Since the base frame 30 made of a metal material may act as a shield blocking other electro-magnetic waves or noise signal around the anisotropic electro-conductive sheet 60, it is advantageous to increase the signal transmission efficiency of the anisotropic electro-conductive sheet 60.

By molding the floor part 311 of the base frame, the tension coupling piece 40 and the position-aligning piece 50 into one metal member, and then by bending the tension coupling piece 40 and the position-aligning piece 50 with respect to the floor part 311 of the base frame, the integrated base frame 30 may be inexpensively manufactured.

In addition to the illustrated structure, the base frame 30 may be modified to have various other structures which support and align the anisotropic electro-conductive sheet 60 and the second electronic component 20, and enable the cover frame 70 to be coupled thereto. Also, the base frame 30 may need not be made of metal but may be made of material other than metal or any combination of materials.

A first fixing part 41 (FIG. 3) is formed on an upper portion of the tension coupling piece 40, and the first fixing part is bent inwardly to have an inner lower inclined surface 411 and an inner upper inclined surface 412. The inner upper inclined surface 412 is formed in a downwardly inclined and bent shape, and serves to easily guide the cover frame 70 to the inner lower inclined surface 411 of the tension coupling piece 40 when the cover frame 70 is coupled with the tension coupling piece 40. That is, when a user presses the cover frame 70 placed on the base frame 30 towards the base frame 30, a first coupling part 71, which is formed on each of both end portions of the cover frame 70 and has an inclined surface corresponding to the inner lower inclined surface 411 of the tension coupling piece 40, is brought into contact with the inner upper inclined surface 412, so the first coupling part may be smoothly slid along the inner upper inclined surface 412 toward an inner side of the base frame 30 to be coupled to the inner lower inclined surface 411 of the tension coupling piece 40. That is, upon application of a downward force on cover frame 70, tension coupling pieces 40 may elastically deform outward to allow cover plate 70 to pass beyond the inner upper inclined surface 412 to the inner lower inclined surface 411.

The first fixing part 41 of the tension coupling piece 40 according to one embodiment of the present disclosure and the first coupling part 71 of the cover frame 70 are formed in the shape of inclined surfaces corresponding to each other to have structures in which the corresponding inclined surfaces are brought into close contact with each other to be coupled to each other.

The position-aligning piece 50 may be provided on the base frame 30. The anisotropic electro-conductive sheet 60 and the second electronic component 20 accommodated in the base frame 30 are position-aligned by the tension coupling piece 40 and the position-aligning pieces 50 of the base frame 30. Various methods for aligning positions of the anisotropic electro-conductive sheet 60 and the second electronic component 20 using the tension coupling piece 40 and the position-aligning piece 50 of the base frame 30 may be employed. For example, as shown in FIG. 3, the tension coupling piece 40 is formed on an intermediate portion of an outer side of the floor part 311 of the base frame 30 and the position-aligning piece 50 is formed at an end portion of a rear side adjacent to the outer side on which the tension coupling piece 40 is formed, so a space 312 is provided between the tension coupling piece 40 and the position-aligning piece 50. Corresponding alignment parts 615 and 212 are formed on the anisotropic electro-conductive sheet 60 and the second electronic component 20, respectively, and these alignment parts are configured to be inserted into the space 312 of the base frame 30. In this manner, by inserting the alignment parts 615 and 212 into the space 312, positions of the anisotropic electro-conductive sheet 60 and the second electronic component 20 may be precisely aligned on the base frame 30.

The anisotropic electro-conductive sheet 60 is disposed on an upper surface of the floor part 311 of the base frame 30 while filling the gap 33 formed between the first base frame 31 and the second base frame 32. In a case where openings 34 are formed in the first base frame 31 and the second base frame 32, the anisotropic electro-conductive sheet 60 is disposed to enable the openings 34 to be also filled therewith.

It is preferable that the anisotropic electro-conductive sheet 60 has a shape that can be disposed on the upper surface of the floor part 311 of the base frame 30 as well as in the space 312 between the tension coupling piece 40 and the position-aligning piece 50. This is to ensure that, by forming the anisotropic electro-conductive sheet 60 to have the alignment part 615 corresponding to the space 312 between the tension coupling piece 40 and the first position-aligning piece 50 and coupling the alignment part 615 to the space 312 using an interference fit or the like, and by also forming the second electronic component 20 to have the alignment part 212 corresponding to the space 312 and coupling the alignment part 212 to the space 312 using an interference fit or the like, the anisotropic electro-conductive sheet 60 and the second electronic component 20 may be precisely aligned with the base frame 30.

In addition, it is possible to position-align the anisotropic electro-conductive sheet 60 or the second electronic component 20 using both sides of the tension coupling piece 40 or the position-aligning piece 50. For example, the anisotropic electro-conductive sheet 60 or the second electronic component 20 is provided in a shape corresponding to both sides of the tension coupling piece 40 or the position-aligning piece 50, and the anisotropic electro-conductive sheet 60 or the second electronic component 20 may be then aligned in a state in which it is fitted in both sides of the tension coupling piece 40 or the position-aligning piece 50.

The anisotropic electro-conductive sheet 60 is bonded to the floor part 311 of the base frame 30. The anisotropic electro-conductive sheet 60 and the floor part of the base frame 30 may be directly bonded to each other using various adhesive materials, or an adhesive film may be interposed between the anisotropic electro-conductive sheet 60 and the floor part 311 to bond them to each other. The anisotropic electro-conductive sheet 60 is bonded to the upper surface of the floor part 311 of the second base frame 32 spaced apart from the first base frame 31 by the predetermined gap 33, so the first base frame 31 and the second base frame 32 are connected to each other through the anisotropic electro-conductive sheet 60.

The anisotropic electro-conductive sheet 60 includes a plurality of electro-conductive parts 61 including a plurality of electro-conductive particles contained in an elastic insulating material, and an insulating part 62 provided to insulate between and support the electro-conductive parts 61.

The electro-conductive part 61 may have an upper protrusion 611 protruding from an upper end thereof above an upper surface of the insulating part 62 such that the electro-conductive part may come smoothly into contact with the second electrode 21 of the second electronic component 20 placed above the anisotropic electro-conductive sheet 60. In addition, the electro-conductive part 61 may have a lower protrusion 612 protruding from a lower end portion thereof below a lower surface of the insulating part 62 such that the electro-conductive part may come smoothly into contact with the first electrode 11 of the first electronic component 10 placed below the anisotropic electro-conductive sheet 60.

In addition, as shown in FIG. 5B, an insulating film 63 having a through hole formed therein at a position corresponding to the electro-conductive part 61 may be formed on the upper surface or the lower surface, or the upper and lower surfaces of the insulating part 62. The insulating film 63 is made of an insulative material and serves to insulate the anisotropic electro-conductive sheet 60 from the first electronic component 10 or the second electronic component 20. In addition, when the electro-conductive part 61 is protrudely formed, the insulating film 63 may function to support the electro-conductive part 61.

As the elastic insulating material constituting the electro-conductive part 61, a heat-resistant polymer material having a crosslinked structure, for example, silicone rubber, polybutadiene rubber, natural rubber, polyisoprene rubber, styrene-butadiene copolymer rubber, acrylonitrile-butadiene copolymer rubber, styrene-butadiene-diene block copolymer rubber, styrene-isoprene block copolymer rubber, urethane rubber, polyester rubber, epichlorohydrin rubber, ethylene-propylene copolymer rubber, ethylene-propylene-Diene copolymer rubber, soft liquid epoxy rubber, and the like may be employed.

In addition, as the electro-conductive particle constituting the electro-conductive part 61, the particles having magnetism may be employed so that they can be reacted by a magnetic field. For example, as the electro-conductive particles, particles obtained by plating a surface of core particle, for example, particles of metals exhibiting magnetism, such as iron, nickel, cobalt, etc., or alloy particles thereof, or particles containing these metals, or particles of these metals, with a metal having excellent electrical-conductivity, such as gold, silver, palladium, radium, or the like; particles obtained by plating a surface of core particle, for example, non-magnetic metal particles, inorganic substance particles such as glass beads or the like, and polymer particles, with electro-conductive magnetic substance such as nickel, cobalt, or the like; or particles obtained by plating core particle with electro-conductive magnetic substance and a metal having excellent electrical-conductivity may be employed.

It is preferable that the electro-conductive portion 61 is disposed in a rectangular region 35 formed by the openings 34 of the first and second base frames 31 and 32 of the base frame 30 and the gap 33. Accordingly, only a portion of the insulating part 62 of the anisotropic electro-conductive sheet 60 may be attached to the floor part 311 of the base frame 30.

It is preferable to utilize an insulator having a low dielectric permittivity for the insulating part 62. Among the insulators, silicone rubber, polyimide-based film, ceramic, Teflon, etc. have a property of a low dielectric permittivity, so, in the present disclosure, it is preferable to form the insulating part 62 from the above materials.

The insulating part 62 and the electro-conductive part 61 may be formed in the same process using the same elastic insulating material. In addition, the insulating part 62 may be produced by forming a through hole in a polyimide film or the like and then forming the electro-conductive part 61 in the through hole.

In addition, the anisotropic electro-conductive sheet 60 may be formed in a coaxial cable structure that transmits a signal well and prevents signal distortion against external signal. In other words, it is possible to utilize the anisotropic electro-conductive sheet having the coaxial cable structure formed therein by forming the insulating parts, which are made of an elastic insulating material, in a plurality of shielding plate holes formed in a metallic electro-conductive shielding plate, forming through holes passing through the insulating parts in parallel with the shielding plate holes, and then forming the electro-conductive parts, which include a plurality of electro-conductive particles contained in an elastic insulating material, in the through holes.

The cover frame 70 is designed to be coupled to the base frame 30 and serves to pressurize the second electronic component 20 placed on the base frame 30 towards the anisotropic electro-conductive sheet 60.

In the anisotropic electro-conductive sheet 60 having the electro-conductive part in which a plurality of electro-conductive particles is contained in an elastic insulating material, when the electro-conductive part 61 is pressurized, the electro-conductive particles come into contact with each other therein to form an electro-conductive passage, so electricity flows in the conductive passage. Therefore, in the data signal transmission connector employing the anisotropic electro-conductive sheet, the base frame 30 and the cover frame 70 should be coupled to each other in a pressurized state to allow the electro-conductive part 61 of the anisotropic electro-conductive sheet 60 to be brought into contact with the first electrode 11 of the first electronic component 10 and the second electrode 21 of the second electronic component 20. A uniform contact characteristic is best maintained for a long period of time when the cover frame 70 applies a constant pressure over the entire electro-conductive part. Therefore, a structure for fixing the tension coupling piece 40 and the cover frame 70 should be formed to have a structure capable of uniformly pressurizing the anisotropic electro-conductive sheet 60 with a constant pressure.

FIGS. 3 and 4 show a fixing structure of the tension coupling piece 40 and the cover frame 70 according to one embodiment of the present disclosure.

The cover frame 70 includes a cover frame body 701 capable of being brought into contact with an upper surface of the second electronic component 20 to pressurize the second electronic component 20, and the first coupling parts 71 provided on both sides of the cover frame body so as to be engaged with the first fixing parts 41 of the tension coupling pieces 40 of the first and second base frames 31 and 32, respectively.

The first coupling part 71 has a shape having an inclined surface corresponding to the inner lower inclined surface 411 of the tension coupling piece 40. Due to this configuration, when the cover frame 70 is pressed against the inner upper inclined surface 412 of the tension coupling piece 40, the inner upper inclined surface 412 is pushed outward with respect to the base frame 30 and the first coupling part 71 of the cover frame 70 is simultaneously moved towards the inner lower inclined surface 411, so the inclined surface of the first coupling part 71 and the inner lower inclined surface 411, which are formed to correspond to each other, are engaged with each other, whereby the cover frame 70 is fixed to the base frame 30. A location where the cover frame 70 is fixed to the tension coupling piece 40 is a location where the electro-conductive part 61 of the anisotropic electro-conductive sheet 60 may be pressurized by the first electrode 11 of the first electronic component 10 and the second electrode 21 of the second electronic component 20 to form the electro-conductive passage.

As shown in FIG. 5, in a state in which the first base frame 31 and the second base frame 32 are connected to each other by the anisotropic electro-conductive sheet 60, the cover frame 70 may be simply fixed to the base frame 30 in the following manner: soldering the first base frame 31 and the second base frame 32 to the first electronic component 10, placing the second electronic component 20 and the cover frame 70 on the anisotropic electro-conductive sheet 60, and then pressing the cover frame 70 against the base frame 30.

The first base frame 31 and the second base frame 32 are fixed to the first electronic component 10 through a solder S, and the electro-conductive part 61 of the anisotropic electro-conductive sheet 60 may be electrically connected to the first electrode 11 of the first electronic component 10. The electro-conductive part 61 of the anisotropic electro-conductive sheet 60 may be electrically connected to the first electrode 11 of the first electronic component 10 through the solder S.

Figure 8:
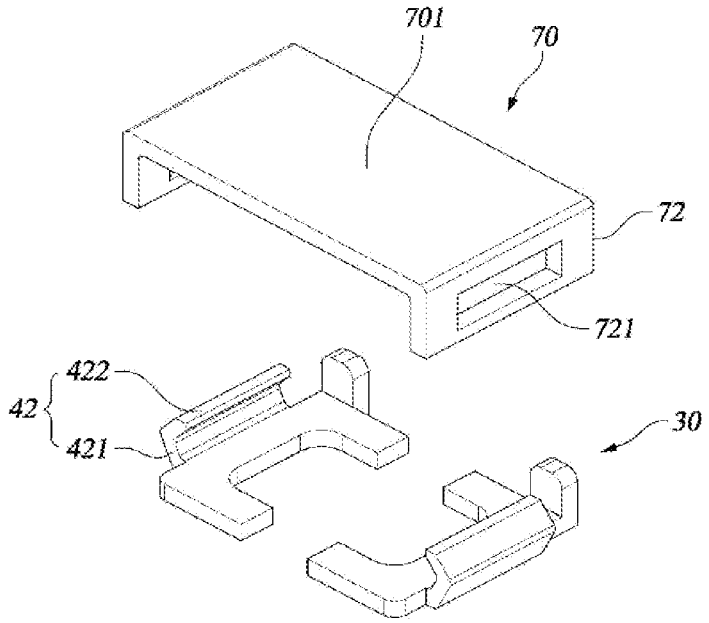
FIGS. 8 and 9 are views showing a fixing structure of a tension coupling piece and a cover frame according to another embodiment of the present disclosure.
Figure 8:
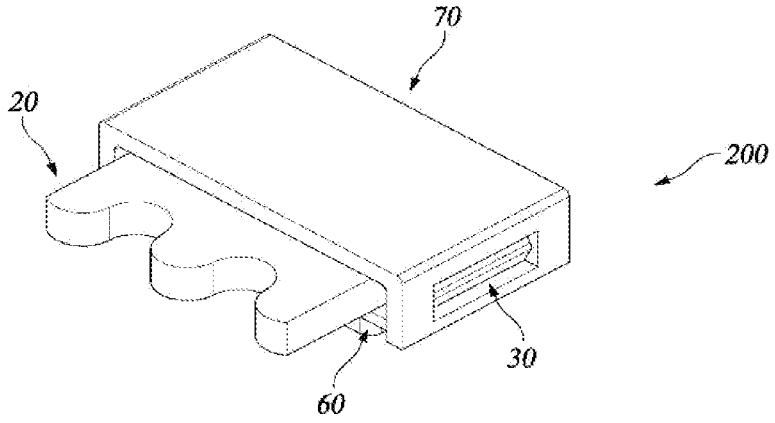

FIG. 8 is a view showing a fixing structure of the tension coupling piece 40 and the cover frame 70 according to another embodiment of the present disclosure. As shown in FIG. 8, the tension coupling pieces of each of the first and second base frames are bent outwardly to form a second fixing part 42 thereon having an outer lower inclined surface 421 and an outer upper inclined surface 422, and the cover frame 70 is provided with second coupling parts 72 formed on both sides thereof, respectively, and a coupling opening 721 is formed in each second coupling part 72 to be coupled with the corresponding second fixing part 42. When the cover frame 70 is pressed against the base frame 30, the second coupling part 72 of the cover frame 70 comes in contact with the outer upper inclined surface 422 of the tension coupling piece, and when the cover frame 70 is continuously pressed, the second fixing part 42 is elastically deformed inward and is then inserted into the coupling opening 721 of the cover frame 70, so the cover frame 70 is coupled to the base frame 30 (FIG. 8B).

Figure 9:
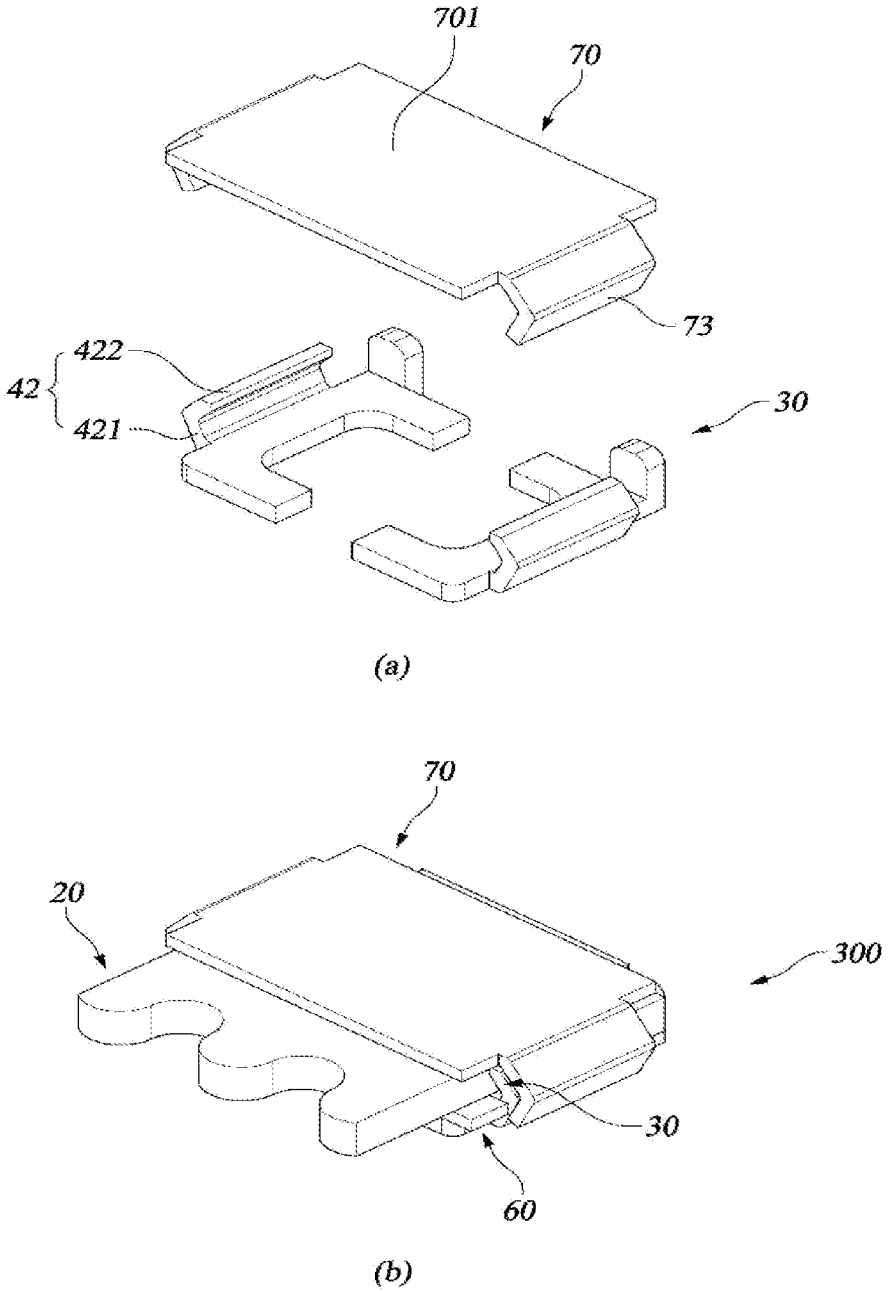

FIG. 9 is a view showing the fixing structure of the tension coupling piece and the cover frame 70 according to yet another embodiment of the present disclosure. The structure of the tension coupling piece is the same as that shown in FIG. 8. On each of both sides of the cover frame 70, a third coupling part 73 bent inward is formed for tightly wrapping an outer surface of the second fixing part 42. When the cover frame 70 is pressed against the base frame 30, the third coupling part 73 of the cover frame 70 comes into contact with the outer upper inclined surface 422 of the tension coupling piece. Then, the second fixing part 42 is elastically deformed inward and the third coupling part 73 is elastically deformed outward and surrounds tightly the second fixing part 42, so the cover frame 70 is coupled to the base frame 30.

Therefore, the fixing structure of the tension coupling piece and the cover frame 70, which is exemplarily described in the present disclosure, may apply a constant pressure to the entire electro-conductive part formed on the anisotropic electro-conductive sheet 60, so a uniform contact characteristic may be maintained for long time period.

In the present disclosure, by removing a portion of the base frame 30 corresponding to a region through which the high-speed signal line formed on the second electronic component 20 passes, the base frame 30 installed close to the high-speed signal line acts as a dielectric and a capacitor or a coil component to prevent signal distortion from occurring. However, since the anisotropic electro-conductive sheet 60 may also cause signal distortion, it is preferable to remove a portion of the anisotropic electro-conductive sheet 60 as well other than the region acting as the electro-conductive portion 61 and the region to which the floor part 311 of the base frame 30 is bonded.

Figure 6:
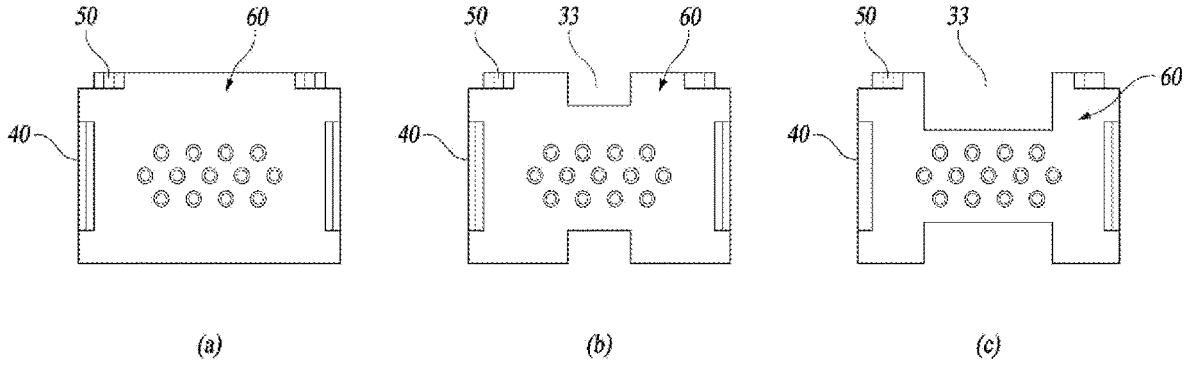
FIG. 6 is a view depicting a modified example of an anisotropic electro-conductive sheet according to the present disclosure.

Although the anisotropic electro-conductive sheet 60 according to one embodiment of the present disclosure is formed in the entire space surrounded by the floor part 311 of the base frame 30 as shown in FIG. 6A, a method of reducing signal distortion by removing a portion of the anisotropic electro-conductive sheet 60, through which the high-speed signal line passes, corresponding to the gap 33 may also be considered (see FIG. 6B).

In addition, in the case of an ultrahigh-speed signal transmission line, as shown in FIG. 6C, it is preferable to minimize signal distortion by removing as much as possible of the sheet, except for a region on which the electro-conductive parts 61 are formed. FIG. 6C shows a configuration in which the anisotropic electro-conductive sheet 60 is partially removed except for a portion where the electro-conductive parts 61 are formed and a minimum portion corresponding to a region of the floor part 31 enabling the anisotropic electro-conductive sheet 60 to be stably supported on the base frame 30.

On the other hand, when the first electronic component 10 and the second electronic component 20 have transversely elongated electrodes, the gap 33 between the first base frame 31 and the second base frame 32 is increased and the anisotropic electro-conductive sheet 60 is also formed to have a transversely elongated shape. Due to the above shape, a pressurizing force applied to the electro-conductive part 61 of the anisotropic electro-conductive sheet 60 connecting the first electrode 11 of the first electronic component 10 and the second electrode 21 of the second electronic component 20 may not be uniformly transmitted to a central portion of the anisotropic electro-conductive sheet.

Figure 7:
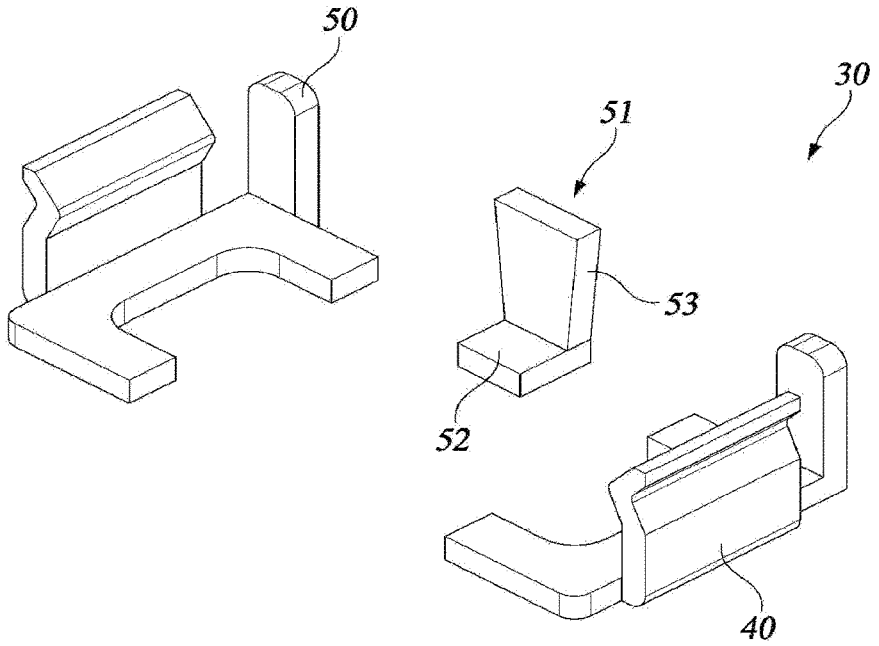
FIG. 7 is a view depicting a base frame applied to a transversely elongated electronic component.

Therefore, in the data signal transmission connector for connecting transversely elongated electronic components, an intermediate frame 51 (FIG. 7) may be formed at an intermediate portion of the gap 33 between the first base frame 31 and the second base frame 32, and this intermediate frame includes an intermediate floor part 52 formed on a plane which is the same as the floor part 311 of the base frame 30 and an intermediate position-aligning piece 53 extending upward from the intermediate floor part 52 and disposed parallel to the position-aligning piece 50. By soldering the intermediate floor part 52 of the intermediate frame 51 to the first electronic component 10 and disposing the anisotropic electro-conductive sheet 60 on upper surfaces of the floor part 311 of the base frame 30 and the intermediate floor part 52 of the intermediate frame 51, a uniform pressurizing force may be transmitted to all electro-conductive parts even in the data signal transmission connector used for the transversely elongated electronic components.

As described above, in the data signal transmission connectors 100, 200 and 300 according to embodiments of the present disclosure, by removing a portion of the base frame 30 close to a portion through which the high-speed signal line passes, it is possible to transmit a high-speed signal without signal distortion or interference. In particular, in the case of ultrahigh-speed signal transmission, signal distortion may be minimized by partially removing the anisotropic electro-conductive sheet as much as possible except for a portion corresponding to a region of the base frame 30 through which the high-speed signal line passes and a portion where the electro-conductive parts are disposed.

In addition, the data signal transmission connectors 100, 200 and 300 according to embodiments of the present disclosure may be easily assembled by fixing the mirror-symmetrical first and second base frames 31 and 32 to which the anisotropic electro-conductive sheet 60 is coupled, to the first electronic element 10 and coupling the second electronic component 20 placed on the anisotropic electro-conductive sheet 60 to the base frame 30 by the cover frame 70 in a simple pressing manner.

In addition, since the electro-conductive part 61 in which the plurality of electro-conductive particles are contained in the elastic insulating material electrically connects the first electrode 11 of the first electronic component 10 and the second electrode 21 of the second electronic component 20, a signal transmission path is shortened as compared with a conventional BTB connector, and uniform signal transmission may be achieved, thereby enabling high-speed signal transmission to be performed.

Although preferred examples of the present disclosure have been described above, the scope of the present disclosure is not limited to the forms described and illustrated above.

For example, the specific structures of the fixing part provided in the base frame and the coupling part provided in the cover frame are not limited to those shown, and may be variously modified. For example, the base frame may be provided with a fixing part having a coupling groove, and the cover frame may be provided with a protrusion-shaped coupling part that can be inserted into the coupling groove.

While the present disclosure has been described with reference to the embodiments illustrated in the figures, the embodiments are merely examples, and it will be understood by those skilled in the art that various changes in form and other embodiments equivalent thereto can be performed. Therefore, the technical scope of the disclosure is defined by the technical idea of the appended claims The drawings and the forgoing description gave examples of the present invention. The scope of the present invention, however, is by no means limited by these specific examples. Numerous variations, whether explicitly given in the specification or not, such as differences in structure, dimension, and use of material, are possible. The scope of the invention is at least as broad as given by the following claims.

What is claimed is:

1. A data signal transmission connector configured to electrically connect a first electronic component having a first electrode and a second electronic component having a second electrode, the data signal transmission connector comprising;

a base frame fixed to the first electronic component and comprising:

a first base frame having a floor part and a tension coupling piece extending upward from an outer surface of the floor part; and a second base frame having a structure which is mirror-symmetrical with respect to that of the first base frame, the first base frame and the second base frame being disposed to face each other and to be spaced apart from each other by a gap;

an anisotropic electro-conductive sheet disposed on the floor parts of the base frame and configured to fill the gap, the anisotropic electro-conductive sheet comprising a plurality of electro-conductive parts including a plurality of electro-conductive particles contained in an elastic insulating material and an insulating part supporting a portion between the electro-conductive parts; and a cover frame connectable to the tension coupling piece and capable of pressurizing the second electronic component placed on the anisotropic electro-conductive sheet towards the anisotropic electro-conductive sheet such that a lower end portion of the electro-conductive part is brought into close contact with the first electrode and the second electrode is brought into close contact with an upper end portion of the electro-conductive part;

wherein the second electronic component has a plurality of high-speed signal lines, and at least some of the plurality of high-speed signal lines are disposed to pass above the gap.

2. The data signal transmission connector of claim 1, wherein the floor part is formed to have a "⊏" shape having an opening formed therein.

3. The data signal transmission connector of claim 2, wherein the electro-conductive part of the anisotropic electro-conductive sheet is formed at a portion corresponding to a rectangular region formed by the openings and the gap.

4. The data signal transmission connector of claim 3, wherein the anisotropic electro-conductive sheet is not disposed on a portion corresponding to the gap outside the rectangular region.

5. The data signal transmission connector of claim 1, wherein each of the first and second base frames further comprises a position-aligning piece formed on a rear side of the floor part and extending upward.

6. The data signal transmission connector of claim 5, wherein the anisotropic electro-conductive sheet and the second electronic component are position-aligned by the tension coupling piece and the position-aligning piece.

7. The data signal transmission connector of claim 5, wherein an intermediate frame is formed within the gap between the position-aligning pieces, and the intermediate frame comprises an intermediate floor part on which the anisotropic electro-conductive sheet is disposed and an intermediate position-aligning piece disposed parallel to the position-aligning piece.

8. The data signal transmission connector of claim 1, wherein a first fixing part is formed on an upper portion of the tension coupling piece, and the first fixing part is bent inwardly to have an inner lower inclined surface and an inner upper inclined surface, and wherein the cover frame has a first coupling part formed on each of both end portions thereof and having an inclined surface corresponding to the inner lower inclined surface.

9. The data signal transmission connector of claim 8, wherein the floor part is formed to have a "⊏" shape having an opening formed therein.

10. The data signal transmission connector of claim 8, wherein each of the first and second base frames further comprises a position-aligning piece formed on a rear side of the floor part and extending upward.

11. The data signal transmission connector of claim 8, wherein an intermediate frame is formed within the gap between the position-aligning pieces, and the intermediate frame comprises an intermediate floor part on which the anisotropic electro-conductive sheet is disposed and an intermediate position-aligning piece disposed parallel to the position-aligning piece.

12. The data signal transmission connector of claim 1, wherein the tension coupling piece is bent outward to form a second fixing part thereon having an outer lower inclined surface and an outer upper inclined surface, and wherein the cover frame has second coupling parts formed at both end portions thereof and extending downward, and the second coupling part has a coupling opening formed therein to be coupled with the second fixing part.

13. The data signal transmission connector of claim 12, wherein the floor part is formed to have a "⊏" shape having an opening formed therein.

14. The data signal transmission connector of claim 12, wherein each of the first and second base frames further comprises a position-aligning piece formed on a rear side of the floor part and extending upward.

15. The data signal transmission connector of claim 12, wherein an intermediate frame is formed within the gap between the position-aligning pieces, and the intermediate frame comprises an intermediate floor part on which the anisotropic electro-conductive sheet is disposed and an intermediate position-aligning piece disposed parallel to the position-aligning piece.

16. The data signal transmission connector of claim 1, wherein the tension coupling piece is bent outward to form a second fixing part thereon having an outer lower inclined surface and an outer upper inclined surface, and wherein the cover frame has third coupling parts formed at both end portions thereof, and the third coupling part is bent inward for wrapping an outer surface of the second fixing part.

17. The data signal transmission connector of claim 16, wherein the floor part is formed to have a "⊏" shape having an opening formed therein.

18. The data signal transmission connector of claim 16, wherein each of the first and second base frames further comprises a position-aligning piece formed on a rear side of the floor part and extending upward.

19. The data signal transmission connector of claim 16, wherein an intermediate frame is formed within the gap between the position-aligning pieces, and the intermediate frame comprises an intermediate floor part on which the anisotropic electro-conductive sheet is disposed and an intermediate position-aligning piece disposed parallel to the position-aligning piece.

* * * * *